US010267166B2

(12) United States Patent
Cosi et al.

(10) Patent No.: US 10,267,166 B2
(45) Date of Patent: Apr. 23, 2019

(54) TURBOMACHINE ROTOR ASSEMBLY AND METHOD

(71) Applicant: Nuovo Pignone Srl, Florence (IT)

(72) Inventors: Lorenzo Cosi, Firenze (IT); Damaso Checcacci, Firenze (IT)

(73) Assignee: NUOVO PIGNONE SRL, Florence (IT)

( * ) Notice: Subject to any disclaimer, the term of this patent is extended or adjusted under 35 U.S.C. 154(b) by 595 days.

(21) Appl. No.: 14/892,388

(22) PCT Filed: May 19, 2014

(86) PCT No.: PCT/EP2014/060266
§ 371 (c)(1),
(2) Date: Nov. 19, 2015

(87) PCT Pub. No.: WO2014/187785
PCT Pub. Date: Nov. 27, 2014

(65) Prior Publication Data

US 2016/0130956 A1 May 12, 2016

(30) Foreign Application Priority Data

May 21, 2013 (IT) ..... FI2013A0117

(51) Int. Cl.
*F01D 5/30* (2006.01)
*F01D 5/32* (2006.01)
*F04D 29/32* (2006.01)

(52) U.S. Cl.
CPC ..... *F01D 5/3007* (2013.01); *F01D 5/3038* (2013.01); *F01D 5/32* (2013.01);
(Continued)

(58) Field of Classification Search
CPC ..... F01D 5/30; F01D 5/3023; F01D 5/303; F01D 5/3038; F01D 5/3061; F01D 5/32;
(Continued)

(56) References Cited

U.S. PATENT DOCUMENTS 822,150 A * 5/1906 Parsons ..... F01D 5/3038 29/889.21
830,878 A * 9/1906 Callan ..... F01D 5/3038 29/889.21

(Continued)

FOREIGN PATENT DOCUMENTS

CA 2616653 A1 6/2009
CH 430754 A 2/1967

(Continued)

OTHER PUBLICATIONS

Office Action and Search issued in connection with corresponding RU Application No. 2015148742 dated Mar. 13, 2018.

(Continued)

*Primary Examiner* — Jason D Shanske
*Assistant Examiner* — Brian O Peters
(74) *Attorney, Agent, or Firm* — GE Global Patent Operation; Marc A. Vivenzio

(57) ABSTRACT

A turbomachine assembly is shown, including a rotor and a ring of blades mounted on the rotor. Each blade includes an airfoil portion and a root portion inserted in a circumferential blade-retaining groove of the rotor. The blade-retaining groove includes an enlarged groove portion. The blades in the enlarged groove portion are rotatable around a respective, generally radial axis, to take a position of minimum tangential dimension. At least one removable insert is arranged along the enlarged groove portion, between the root portions of the blades located in the enlarged groove
(Continued)

portion and a side wall of the blade-retaining groove, to force and lock the blades in a final assembled arrangement.

21 Claims, 11 Drawing Sheets

(52) U.S. Cl.
CPC ..... *F04D 29/322* (2013.01); *F05D 2230/644* (2013.01); *F05D 2260/30* (2013.01); *F05D 2260/36* (2013.01)

(58) Field of Classification Search
CPC .... F04D 29/322; F04D 29/325; F04D 29/327; F04D 29/329; F04D 29/34
See application file for complete search history.

(56) References Cited

U.S. PATENT DOCUMENTS

| | | | | | |
|---|---|---|---|---|---|
| 835,472 | A | * | 11/1906 | Rotter | F01D 5/3038 29/889.21 |
| 883,926 | A | * | 4/1908 | Alexander | F01D 5/3038 29/889.21 |
| 940,778 | A | * | 11/1909 | Barton | F01D 5/3038 29/889.21 |
| 1,156,529 | A | | 10/1915 | Hillner | |
| 1,166,530 | A | * | 1/1916 | Lovekin | F01D 5/3038 29/889.21 |
| 1,328,640 | A | * | 1/1920 | Parsons | F01D 5/3038 416/216 |
| 2,410,588 | A | | 11/1946 | Phelan et al. | |
| 3,328,867 | A | | 7/1967 | Guengant | |
| 3,383,094 | A | | 5/1968 | Diggs | |
| 5,511,948 | A | | 4/1996 | Suzuki et al. | |
| 6,158,104 | A | | 12/2000 | Roberts et al. | |
| 6,416,286 | B1 | | 7/2002 | Roberts et al. | |
| 7,168,919 | B2 | | 1/2007 | Blatchford et al. | |
| 7,819,630 | B2 | | 10/2010 | Nogami et al. | |
| 7,901,187 | B2 | | 3/2011 | Barber | |
| 2005/0249599 | A1 | | 11/2005 | Hemsley et al. | |
| 2011/0200441 | A1 | | 8/2011 | Blatchford | |
| 2012/0063916 | A1 | | 3/2012 | Boyer | |
| 2013/0170996 | A1 | * | 7/2013 | Farineau | F01D 5/225 416/219 R |

FOREIGN PATENT DOCUMENTS

| | | | | | |
|---|---|---|---|---|---|
| CH | 430754 | | * | 8/1967 | F01D 11/02 |
| CN | 102086781 | A | | 6/2011 | |
| DE | 3028701 | A1 | | 2/1982 | |
| EP | 1744013 | A2 | | 1/2007 | |
| GB | 190910902 | A | | 5/1910 | |
| GB | 623557 | A | | 5/1949 | |
| GB | 2171150 | A | | 8/1986 | |
| RU | 2 375 589 | C2 | | 12/2009 | |

OTHER PUBLICATIONS

Unofficial English Translation of Chinese Office Action issued in connection with corresponding CN Application No. 201480029554.2 dated Sep. 13, 2016.
Italian Search Report and Opinion issued in connection with corresponding IT Application No. FI2013A000117 dated Feb. 3, 2014.
PCT Search Report and Written Opinion issued in connection with corresponding Application No. PCT/EP2014/060266 dated Aug. 25, 2014.

* cited by examiner

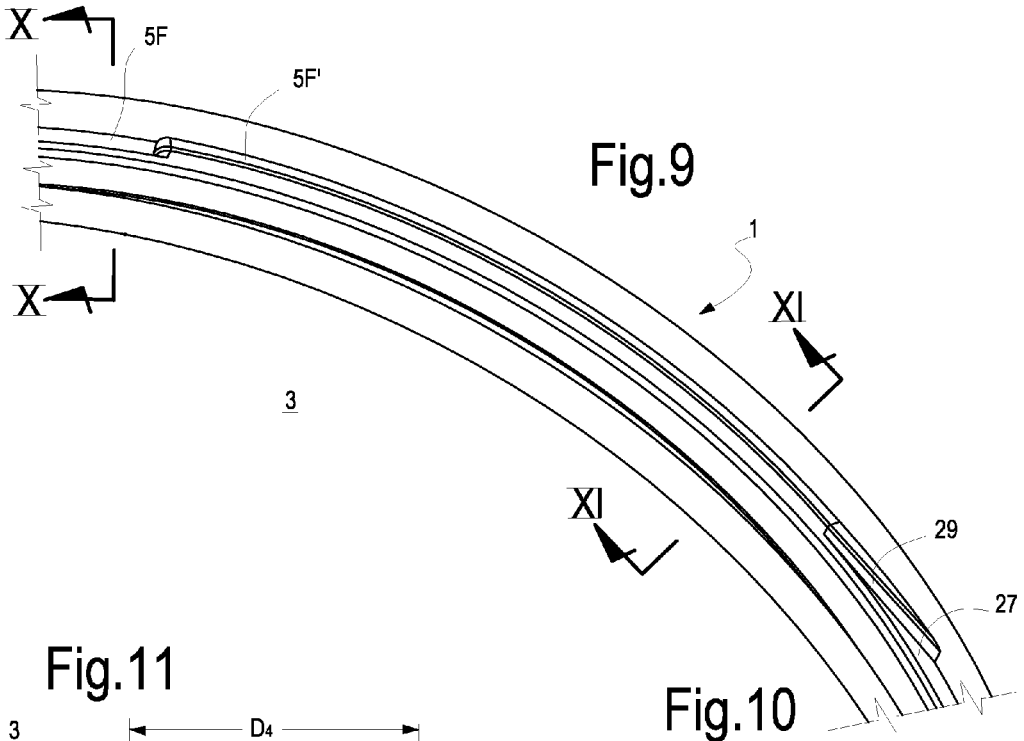
Fig.9
Fig.11
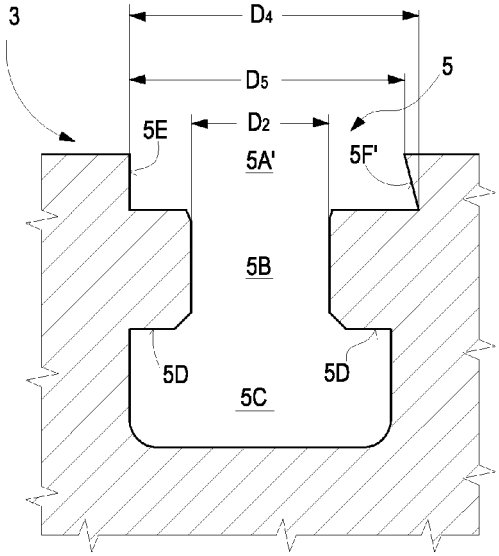
Fig.10
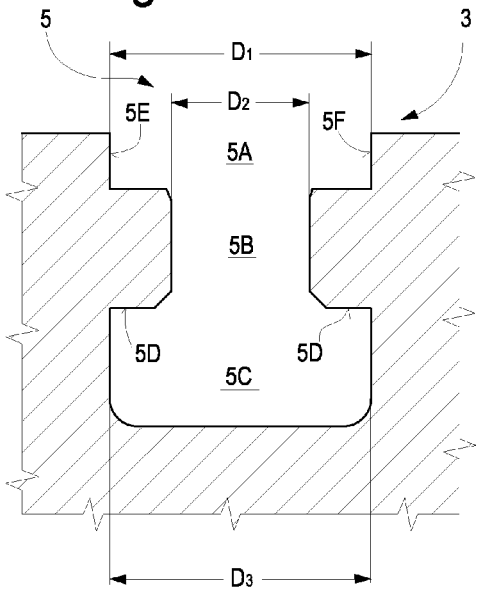

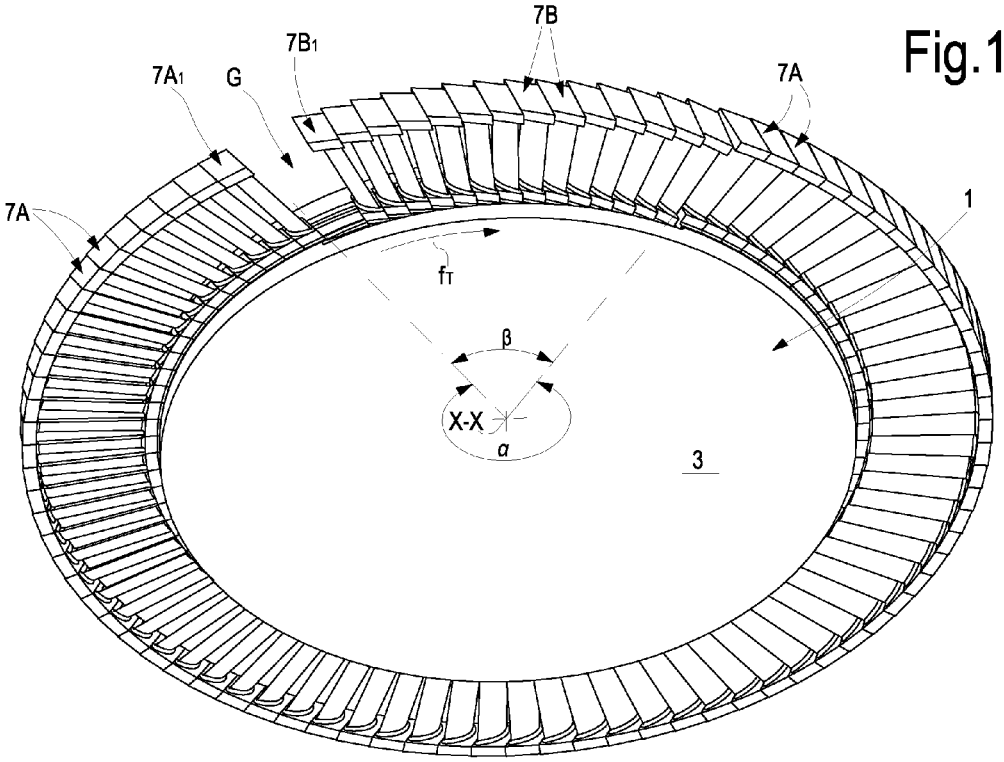
Fig.15
Fig.16
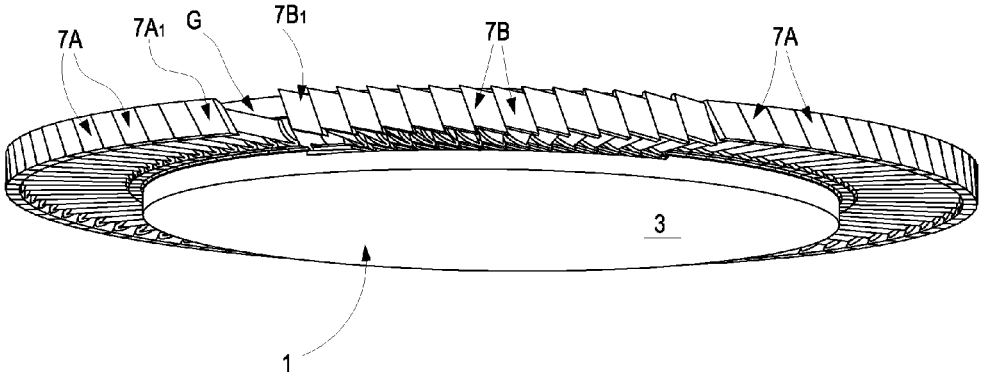

STATE OF THE ART

TURBOMACHINE ROTOR ASSEMBLY AND METHOD

CROSS-REFERENCE TO RELATED APPLICATIONS

This application is a national stage application under 35 U.S.C. § 371(c) of prior filed, co-pending PCT application serial number PCT/EP2014/060266, filed on May 19, 2014, which claims priority to Italian Patent Application Serial No. FI2013A000117, titled "TURBOMACHINE ROTOR ASSEMBLY AND METHOD" filed May 21, 2013. The above-listed applications are herein incorporated by reference.

BACKGROUND

Field of the Invention

Embodiments of the invention relate to methods for assembling turbomachine blades on a turbomachine rotor, in particular blades for an axial turbomachine, such as a gas turbine, an axial compressor, or a steam turbine. The disclosed subject matter also relates to a turbomachine rotor.

Description of the Related Art

A turbomachine drum rotor usually comprises a drum with a blade-retaining groove circumferentially developing around the drum and having a generally T-shaped cross section. The blades comprise each an airfoil portion and a root portion, which is generally T-shaped and intended for retention in the blade-retaining groove of the rotor.

The blades are constrained to the rotor by introducing the root portion in the blade-retaining groove and thereafter twisting the blade about a radial axis, to engage the root portion in the undercut formed by the T-shaped blade-retaining groove.

The number of blades must be sufficient to form a complete annular blade arrangement and are tangentially forced one against the other to resist pressure and vibrations. Several solutions have been developed to introduce the blades in the T-shaped groove and finally force them tangentially one against the other.

In some known turbine rotor arrangements, in order to assemble a complete ring of blades around the rotor, the last blade to be introduced has a root portion which is not T-shaped and which is introduced in an insert space which has, with respect to the width of the T-shaped blade-retaining groove, a larger dimension in the axial direction, i.e. in a direction parallel to the axis of rotation of the rotor. The last blade is retained by locking it with two insertion pieces introduced in the insert space, with the aid of radial screws. When the last blade is introduced and locked, a complete blade ring is formed and the blades are tangentially forced one against the other. U.S. Pat. No. 7,901,187 discloses this kind of construction.

FIG. 23 schematically illustrates a portion of a turbine rotor and relevant blades, showing in particular the last blade which has been mounted on the rotor. The rotor is indicated with reference number 100. Blades 102 are mounted around the rotor and retained in an undercut blade-retaining groove, e.g. having a generally T-shaped cross section, and extending circumferentially around the rotor. Each blade except the last one has a T-shaped root portion (not shown) engaging the undercut groove. The blades 102 are introduced into the blade-retaining groove in correspondence of an insert space shown at 103. The last blade 105 is introduced in the insert space 103 after insertion therein of two opposed insert pieces 107. The insert pieces 107 and the last blade 105 are locked on the rotor or drum 100 by means of screws 109, 111.

This known mounting system has some drawbacks, including a reduced efficiency in the retention of the last blade 105. The latter is radially retained against the centrifugal forces, which are generated during rotation of the rotor, by means of the screws 109, 111. In order to obtain a sufficient radial retention effect, the screws must deeply engage into the rotor. This results in stress concentration, especially in turbomachines subject to high operating temperatures, such as those arising in steam turbines.

U.S. Pat. No. 7,168,919 describes a further known arrangement for mounting and tangentially locking the blades on a rotor drum. In this known arrangement, each blade has a root with opposite raised portions extending in the axial direction of the root. The blades are introduced in the T-shaped groove in a radially staggered arrangement, so that the respective raised portions are initially radially staggered. Finally the blades are displaced radially outwardly so that the raised portions of all the blades are in radial alignment thus eliminating the clearance between adjacent blades and forcing the blades one against the other in the tangential direction. Machining of the blades is very complex and in the assembling process it is very difficult to control and adjust the final tangential interference.

In other known arrangements, shims are forcedly introduced between roots of adjacent blades, to generate tangential interference between the blades and force them one against the other in tangential direction. The shims are locked by means of screws. Also this arrangement proved not to be satisfactory since it requires critical machining at assembly. In addition the shims must be thick to be forcedly introduced and to host the retaining screws. This requires blades of uneven root pitch, so that the blade row cannot be optimized from the point of view of stress resistance.

There is therefore a need for a more efficient system of mounting the blades on a turbomachine rotor and especially a more efficient way of inserting the last blade and closing the whole blade ring.

SUMMARY OF THE INVENTION

According to the subject matter disclosed herein, in an embodiment, the rotating blades of a single turbomachine stage are assembled on the rotor by means of root portions engaging in an undercut blade-retaining groove or channel, which extends circumferentially around the rotor axis. The blade-retaining groove and the blade root portions are shaped so as to radially engage each blade to the rotor. The blade-retaining groove is provided with an undercut, for example a portion of the cross section thereof is T-shaped to form a dovetail connection, wherein a similarly T-shaped or dovetail shaped part of the root portion of each blade engages. The blade retaining groove has an enlarged portion. The blades introduced along the enlarged groove portion can be over-twisted with respect to their final assembled angular position, so as to temporarily take a position of minimum tangential dimension, generating a free gap. The last blade is introduced in the gap and twisted to engage in the undercut formed by the blade-retaining groove. Tangential inserts are finally introduced in the enlarged groove portion to force the over-twisted blades back in the final angular position by rotating each blade around the respective radial axis thereof. In back-twisting the blades in the final angular position, the tangential dimension thereof is increased and clearances between adjacent blades are eliminated. A full ring of blades is obtained. The blades are radially retained in the blade-retaining groove in an efficient manner, without the need for a complex shaping of the blade root portions and without making use of critical blade-rotor constraining means involving radial screws and similar locking members.

According to some embodiments, a turbomachine assembly is therefore provided, comprising a rotor and a ring of blades mounted on the rotor, each blade comprising an airfoil portion and a root portion inserted in an undercut blade-retaining groove of the rotor. The blade-retaining groove extends circumferentially around the rotation axis of the rotor on the outer periphery of a rotor core or rotor drum. The blade-retaining groove comprises an enlarged groove portion, extending along a fraction of the circumferential development of the groove, e.g. from about 20° to about 100°, more particularly from about 30° to about 60°. The enlarged groove portion has a part of the cross section thereof which has a dimension in the axial direction (i.e. parallel to the rotation axis of the rotor) which is larger than the remaining portion of the groove. The blades in the enlarged groove portion are rotatable around a generally radial axis, to take a position of minimum tangential dimension. A plurality of removable inserts are arranged along the enlarged groove portion, between the blade root portions and a side of the groove, to force and lock the blades in a final assembled position. In the position the blades can be in a condition of mutual interference.

An undercut blade-retaining groove in the context of the present disclosure shall be understood as a groove having a cross sectional shape suitable for radially engaging the root portions of the blades, e.g. a T-shaped or dovetail shaped cross-section.

In some embodiments, each blade can be provided with an outer shroud portion. Once assembled in the final position, the shroud portions of adjacent blades are in reciprocal contact so as to form a continuous annular shroud surrounding the blades forming the blade ring around the rotor axis.

According to a further aspect, the subject matter disclosed herein concerns a method of assembling a turbomachine assembly as described above, comprising the steps of: inserting and twisting a first set of blades into engagement of their roots in the blade-retaining groove; inserting a second set of blades in the enlarged portion of the blade-retaining groove and over-twisting the second set of blades around respective radial axes thereof, so that the blades of the second set of blades takes an angular position of reduced tangential dimension, thus creating a free gap in the blade-retaining grove; introducing a last blade in the free gap and over-twisting the last blade around a respective radial axis; sequentially introducing the removable inserts in the enlarged groove portion, between the roots of the second set of blades and an opposing side surface of the enlarged groove portion, thereby sequentially twisting the blades of the second set of blades in a final angular position.

According to yet a further aspect, the subject matter disclosed herein concerns a method of disassembling a turbomachine assembly as described above, comprising the steps of: removing the removable inserts from the enlarged groove portion; over-twisting the blades in the enlarged groove portion, thus creating a gap; twisting one of the blades arranged along the enlarged groove portion, thus disengaging the root portion thereof from the blade-retaining groove and radially removing the twisted blade; removing the remaining blades from the blade-retaining groove.

Features and embodiments are disclosed here below and are further set forth in the appended claims, which form an integral part of the embodiments of the present description.

The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein:

FIG. 9 illustrates a different view of a detail of a peripheral portion of the rotor drum of FIG. 8;

FIGS. 10 and 11 illustrate two sections according to lines X-X and XI-XI of FIG. 7 of the blade-retaining groove of the rotor drum;

FIGS. 15 and 16 illustrate perspective views of the rotor drum with all but the last blade mounted around the rotor drum;

DETAILED DESCRIPTION

Figures 1, 2, 3:
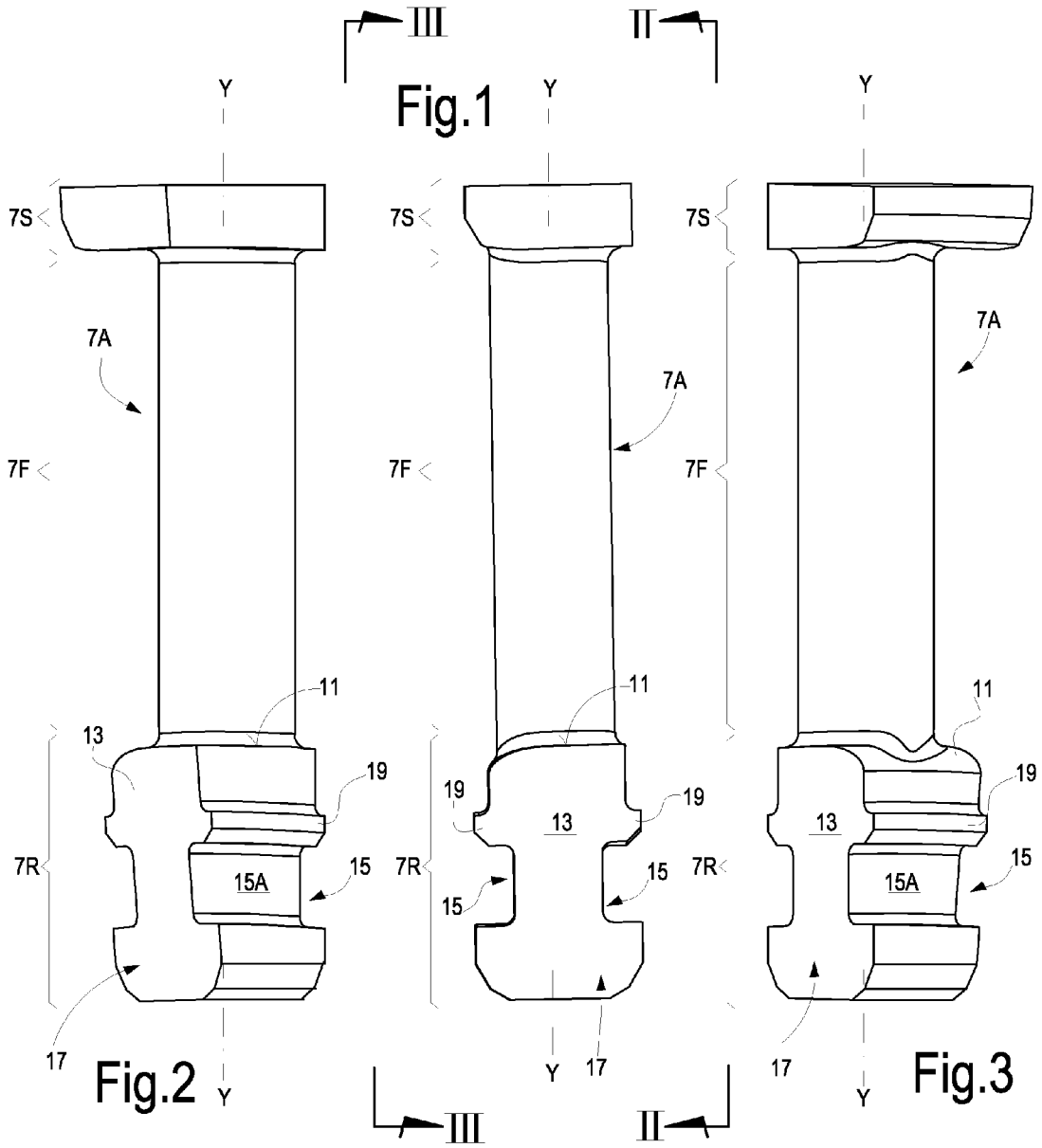
FIG. 1 illustrates a side view of one of the blades of a first set of blades according to the present disclosure.
FIGS. 2 and 3 illustrate views of the blade of FIG. 1 according to lines II-II and III-III respectively.

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

In the following description and enclosed drawings reference will be made to a single disk of a turbine rotor, around which a ring of blades is mounted. It shall be understood that a plurality of such disks or a drum with a plurality of rings of blades can be provided, depending upon the number of stages of the turbomachine. In general, a turbomachine will as a matter of fact include a plurality of stages, each stage comprising a ring of rotating blades mounted on the rotor and a ring of stationary blades mounted on a stationary portion of the machine. The blades of some or all the stages can be mounted on the rotor as described here below.

Moreover, reference will be specifically made to a turbine and in particular to a steam turbine, by way of example. It shall however be understood that the same mounting technique can be used for assembling the blades in different kinds of turbomachines, e.g. in axial compressors or gas turbines.

In the drawings a rotor 1 is comprised of a central drum 3 around which a plurality of blades 7A, 7B are arranged in a ring configuration. In the drawings only a "slice" of the rotor 1 is shown, which corresponds to one of the turbine stages. It shall be understood that in actual fact the rotor has an axial extension depending to the number of stages and that for each stage a ring of blades is mounted on the rotor drum along a corresponding blade-retaining groove.

FIGS. 1-3 and 4-6 illustrate in detail the shape of the blades 7A and 7B respectively. The structure of the blades will be described in greater detail later on.

The rotor 1 has a rotation axis X-X and for each stage of the turbomachine an undercut blade-retaining groove 5 developing circumferentially around the rotor 1. The blade-retaining groove 5 is shaped such as to retain the blades 7A, 7B mounted thereon by means of a dovetail or T-shaped cross section of the blade retaining groove 5 and a correspondingly shaped root portion of the blades 7A, 7B. Generally speaking the cross sectional shape of the blade-retaining groove 5 and the corresponding shape of the blade root portions are such that the blades can be constrained to the rotor by engaging the root portions of the blades in an undercut formed by the blade-retention groove 5.

In some embodiments (see FIGS. 7-11) the blade-retaining groove 5 comprises an inlet slot or platform slot 5A, an intermediate neck portion 5B and a bottom portion 5C. The inlet slot 5A has a dimension D1 in the axial direction, i.e. in the direction parallel to the rotation axis X-X of the rotor 1. The intermediate portion 5B of the blade-retaining groove 5 has a width D2, smaller than D1, and the inner or bottom portion 5C has a width D3. The width D3 can be identical to D1, as shown in FIG. 10, or different, e.g. larger than D1. The cross section of the blade-retaining groove 5 thus forms an undercut 5D for radial retention of the blades 7A, 7B. The inlet slot 5A is bounded by two annular, more particularly planar side walls or surfaces 5E, 5F. In some embodiments, the side walls 5E, 5F are generally parallel to one another and can be orthogonal to the rotor axis X-X. In other embodiments, the side walls 5E, 5F can be non-parallel.

Figure 7:
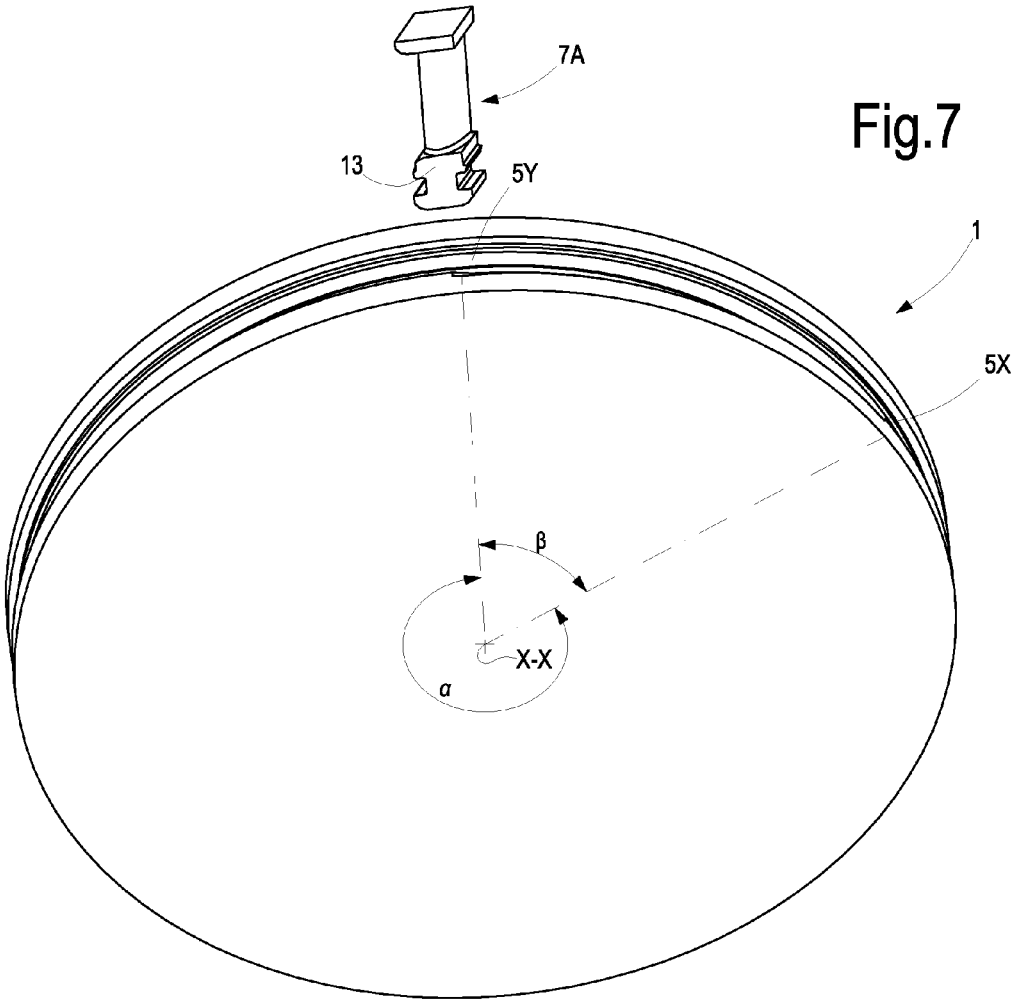
FIG. 7 illustrates a portion of a rotor drum.
Figure 13:
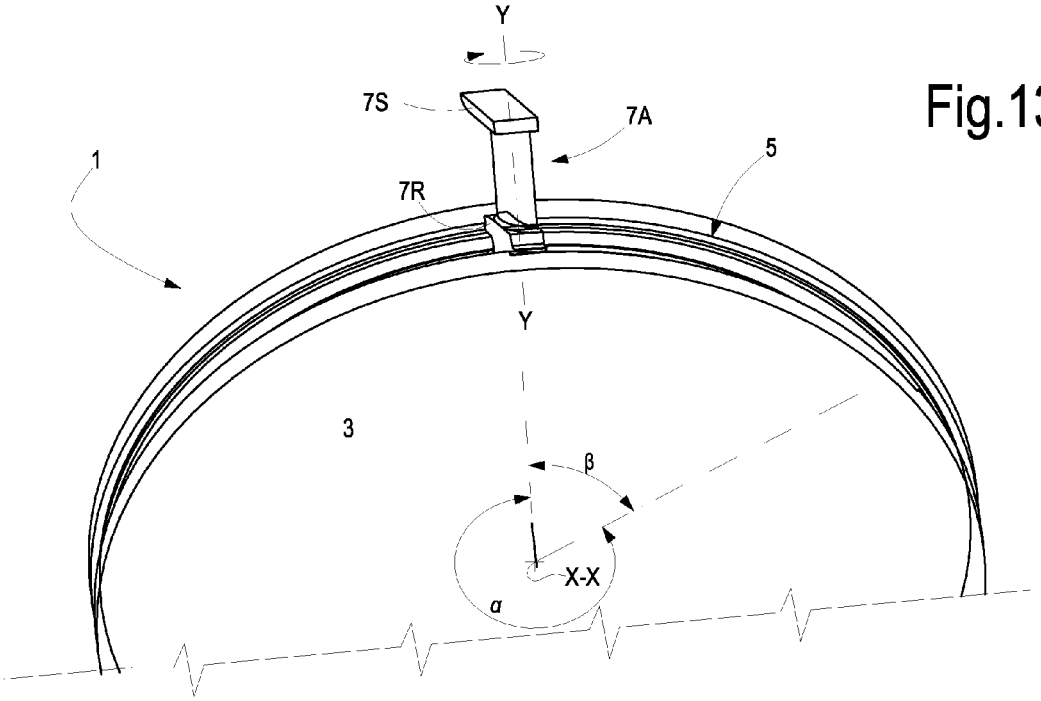

The cross-section of the blade-retaining groove 5 shown in FIG. 10 is constant along the entire circumferential extension of the blade-retaining groove 5 corresponding to an angle $\alpha$ (see e.g. FIGS. 7, 13). Along the remaining portion of the circumferential extension thereof, the blade-retaining groove 5 has a slightly different cross sectional shape, as shown in FIG. 11. Along the remaining portion, corresponding to an angle $\beta$ (see FIGS. 7, 13, for instance), and extending from a first end 5X to a second end 5Y, the blade-retaining groove 5 has an enlarged cross-section. In an embodiment, angle $\beta$ can range between e.g. about 20° and 100°, particularly between about 25° and 80°, and more particularly between about 30 and 60°, for example. This portion of the blade-retaining groove 5 will be referred to herein as the "enlarged groove portion".

The cross section of the enlarged groove portion substantially corresponds to the cross section of the blade-retaining groove 5 along the portion corresponding to angle $\alpha$, except for a different shape of the inlet slot or platform slot 5A. Along the enlarged groove portion the inlet slot 5A is formed between side wall 5E and an opposing, slanted side wall 5F'. This latter wall is inclined and radially outwardly converging towards the opposing side wall 5E. In some embodiments the slanted side wall 5F' can be substantially conical, the axis of the conical surface thereof being coincident with the rotation axis X-X of the rotor 1. The side wall 5F' can also have a shape different than the one shown in the drawings. In general, the side wall 5F' is shaped so as to form an undercut for the purposes which will become apparent from the following description.

The width of the inlet slot 5A along the enlarged groove portion is thus variable from a minimum dimension D5 to a maximum dimension D4. D5 is larger than D1. In other embodiments the width of the inlet slot 5A along the enlarged groove portion can vary stepwise, increasing in a radially inwardly direction, so as to form an undercut.

For the reasons which will become apparent from the following description, each ring of blades mounted in one of the blade-retaining grooves 5 of the rotor 1 is comprised of two types of blades, forming a first set of blades 7A and a second set of blades 7B, which slightly differ from one another. FIGS. 1 to 3 illustrate one blade 7A in isolation. Each blade 7A comprises an intermediate airfoil portion 7F, an optional radially outer shroud portion 7S and a radially inner root portion 7R. Between the root portion 7R and the airfoil portion 7F the blade 7A is provided with a platform 11. The root portion 7R has two generally planar surfaces 13 which, when the blade 7A is mounted on the rotor 1, extend radially and generally inclined e.g. up to about 30° or 40° to the rotor axis X-X. The root portion 7R of each blade 7A further comprises two side indentations 15, which define a lower T-shaped section or undercut section of the root portion 7R of the blade. The T-shaped section, labeled 17, can be engaged in the undercut section 5C of the blade-retaining groove 5, each blade 7A being locked in the blade-retaining groove 5 as will be described later on.

The platform 11 extends sideways above the indentations 15 forming two opposing ledges 19. When the blade 7A is in its final assembled position on the rotor 1 the ledges 19 coact with the side walls 5E, 5F defining the inlet slot 5A of the blade-retaining groove 5.

Figures 4, 5, 6:
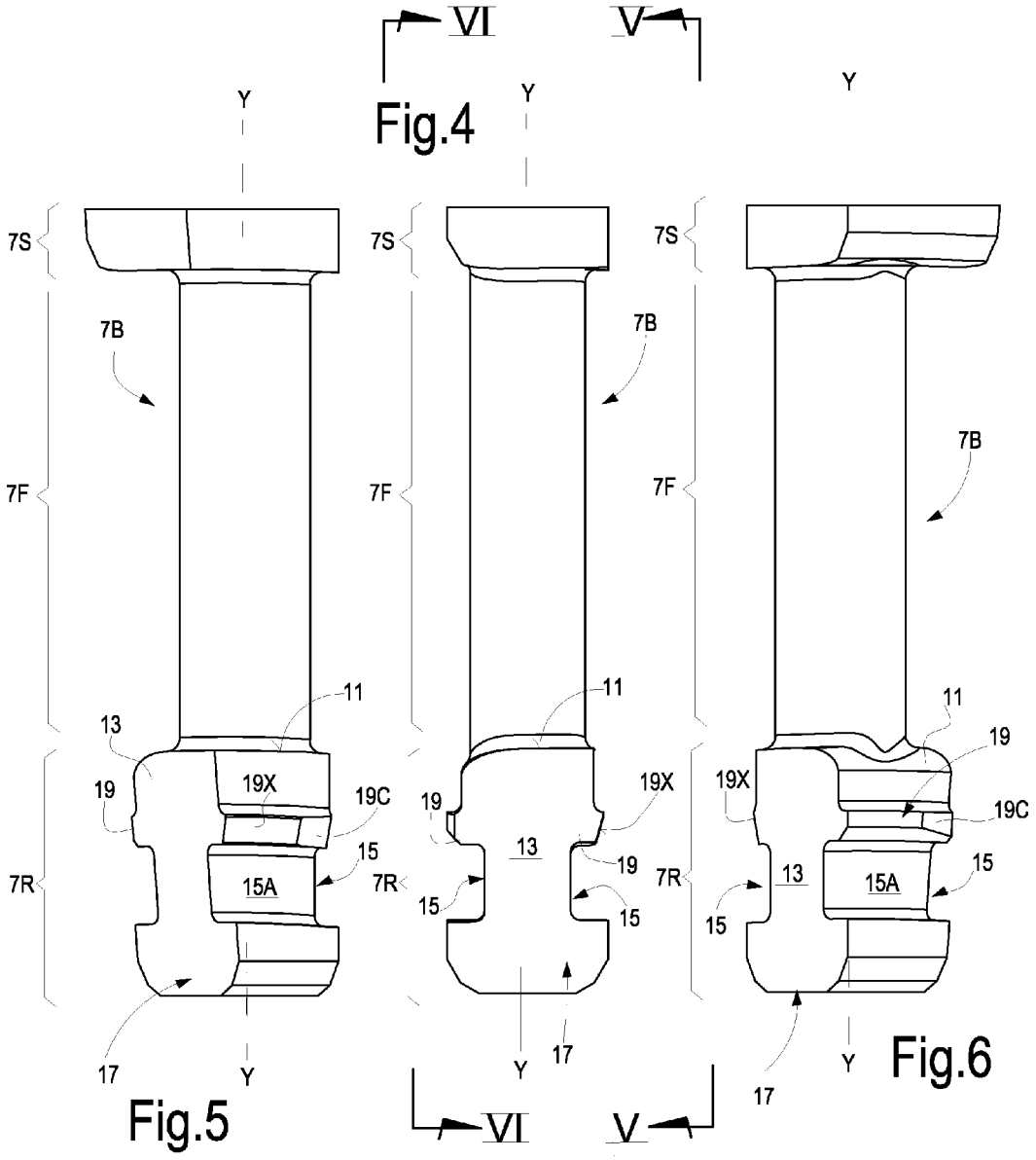
FIG. 4 illustrates a view, similar to FIG. 1, of one of the blades of a second set of blades according to the present disclosure.
FIGS. 5 and 6 illustrate views of the blade of FIG. 4 according to lines IV-IV and V-V respectively.

FIGS. 4 to 6 illustrate one blade 7B of the second set of blades, in isolation. The same reference numbers designate the same or corresponding parts as already described in connection with blade 7A. The main difference between the blades 7A of the first set or type and the blades 7B of the second set or type is the shape of one of the two ledges 19. As can best be appreciated by comparing FIGS. 1 and 4, one of the ledges 19 (the right-hand one in the drawings) of blade 7B has a slanted surface 19X. The total width of the blade 7B at the level of the ledges 19 is thus smaller than the width of the blade 7A. In some embodiments, both ledges 19 of the blades 7B can be chamfered at one end, as shown at 19C (FIGS. 5, 6).

Each ring of blades of a turbomachine stage is formed by a larger number of blades 7A and a smaller number of blades 7B. The blades 7A are arranged around the major portion of the blade retaining-groove 5, along angle α, while the blades 7B of the second set of blades are located in the enlarged groove portion extending from point 5X to point 5Y along angle β of the rotor.

The procedure for mounting each blade 7A of the first plurality or set of blades in the blade-retaining groove 5 will now be described reference being made to FIGS. 7, 12, 13 and 14. The distance between the two surfaces 13 delimiting the root portion 7R of the blade 7 is slightly smaller than the axial dimension D2 of the intermediate section 5B of the blade-retaining groove 5, so that each blade 7 can be introduced in the blade-retaining groove 5, by orienting the root portion 7R with the two planar surfaces 13 approximately orthogonal to the rotation axis X-X of the rotor. In FIG. 7 a first blade 7A is shown in the starting position. The root 7R of the blade 7A is introduced in the blade-retaining groove 5. Once the blade root 7R has been introduced in the blade-retaining groove 5, the blade 7A is twisted or rotated around a radial axis Y-Y thereof. In the final twisted position the surfaces 15X of the indentations are substantially orthogonal to the rotation axis X-X of the rotor 1. By twisting the blade 7A, the T-shaped section 17 of the root portion 7R of the blade 7A engages the bottom portion 5C of the enlarged blade-retaining groove 5, so that the blade 7A is radially engaged in the enlarged blade-retaining groove 5. In the final twisted position one of the ledges 19 of the platform 11 abuts against the side surface 5E of the inlet slot 5A of the enlarged blade-retaining groove 5. The blade 7A is then displaced tangentially in the non-enlarged blade retaining groove to reach its final position in the blade row and with both ledges 19 engaging surfaces 5E and 5F.

Figure 14:
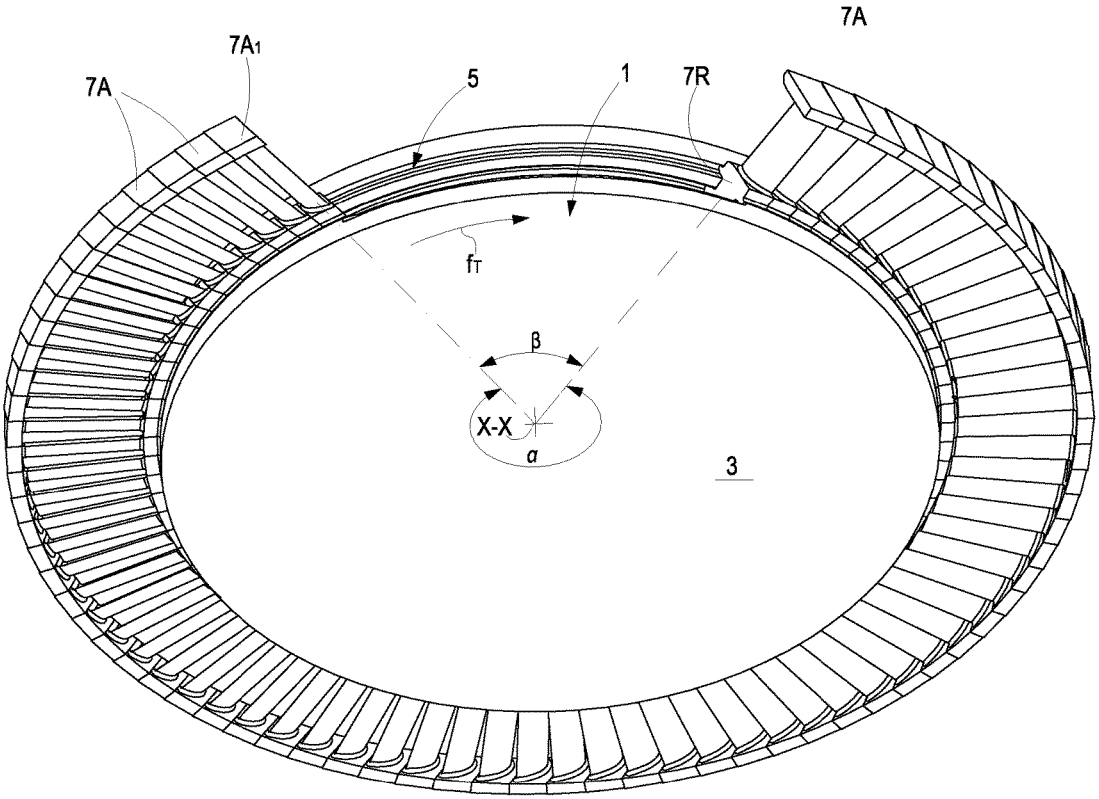
FIG. 14 illustrates a perspective view of a rotor drum portion with a partially assembled blade ring.

This procedure is repeated for a number of blades 7A sufficient to fill the entire blade-retaining groove 5 except the enlarged groove portion, i.e. until a partial blade ring extending along an angle α is formed, as shown in FIG. 14. The blades 7A thus mounted are locked in their angular position and do not rotate around their respective radial axes Y-Y as the ledges 19 abut against side surfaces 5E, 5F of the blade-retaining groove 5.

The blade root 7R can be suitably chamfered or rounded in a manner known to those skilled in the art, to reduce the dimension D2 of the blade-retaining groove 5 and to increase the number of blades 7A forming each blade ring, i.e. to increase the angle α.

Once a number of blades 7A sufficient to fill the blade-retaining groove 5 along the angle α have been mounted on the rotor 1, the blades 7B of the second set of blades are mounted along the remaining enlarged groove portion in quite the same manner.

As mentioned above, the inlet slot 5A of the blade-retaining groove 5 along the enlarged groove portion is wider that the inlet slot 5A of the remaining major portions of the blade-retaining groove 5, so that the blades 7B of the second set of blades can be over-twisted once introduced with their root portion 7R in the blade-retaining groove 5, as shown in FIGS. 15 and 16. Over-twisted means that once the root portion 7R of a blade 7B has been introduced in the enlarged groove portion, the blade 7B is rotated about its radial axis Y-Y by an angle greater than the angle required to achieve the final position of the blade. Over-twisting is made possible by the enlarged axial dimension D4, D5 of the inlet slot 5A along the enlarged groove portion and by the reduced dimension of one of the ledges 19 of the blades 7B of the second set of blades 7B. The chamfer 19C of the ledges 19 of blades 7B (FIGS. 4-6) increases the entity of the over-twisting movement.

Figure 17:
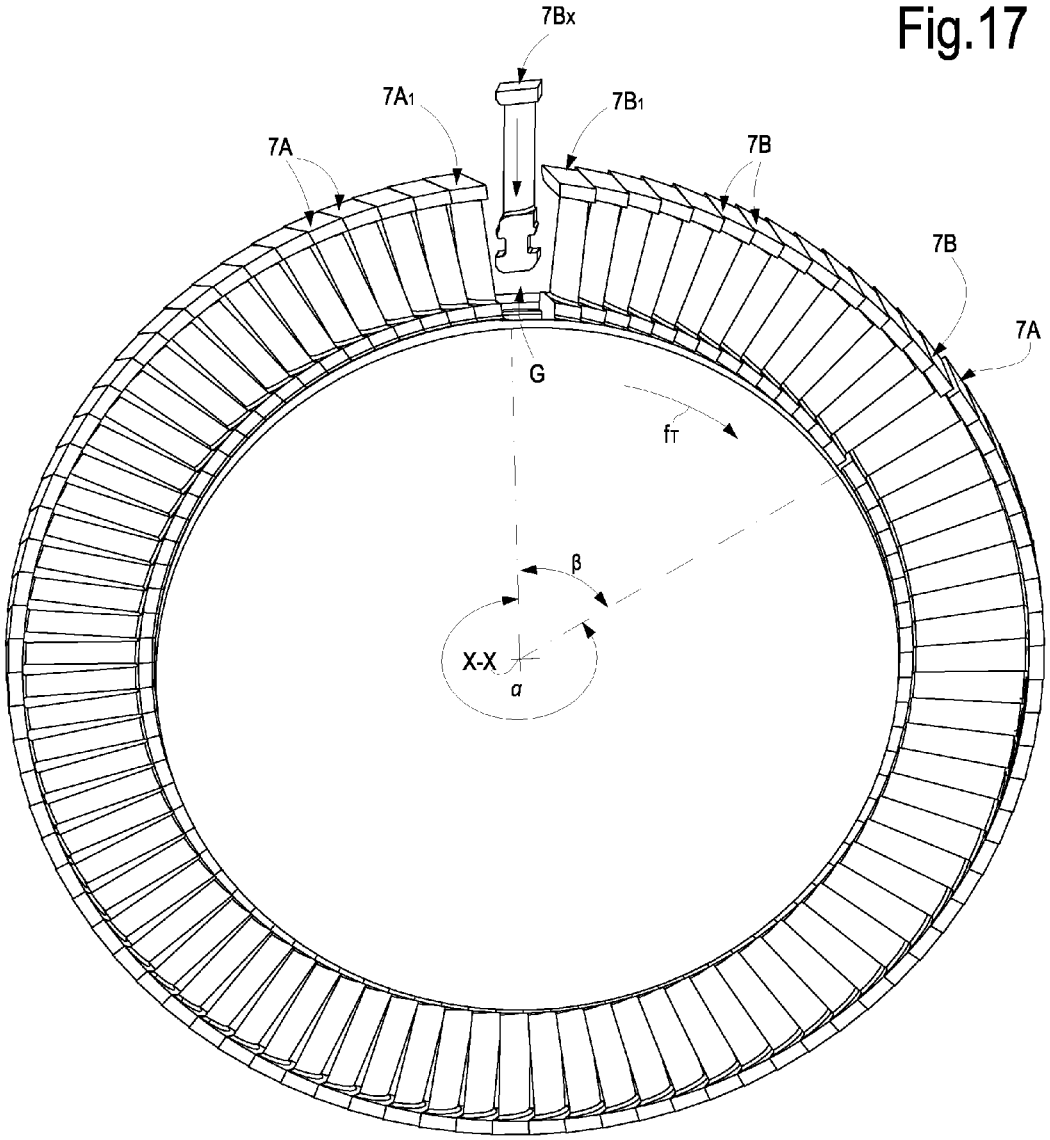
FIG. 17 illustrates the final step of insertion of the last blade.
Figure 19:
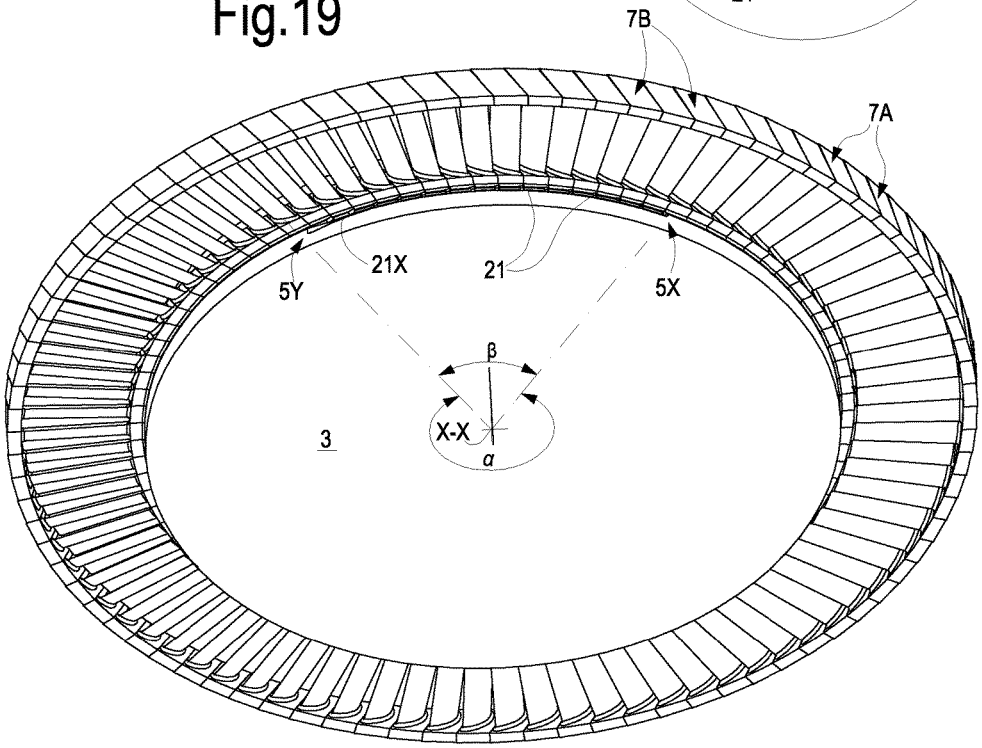
FIGS. 19 and 20 illustrate perspective views of the rotor with the blade ring in the final assembled position.
Figure 20:
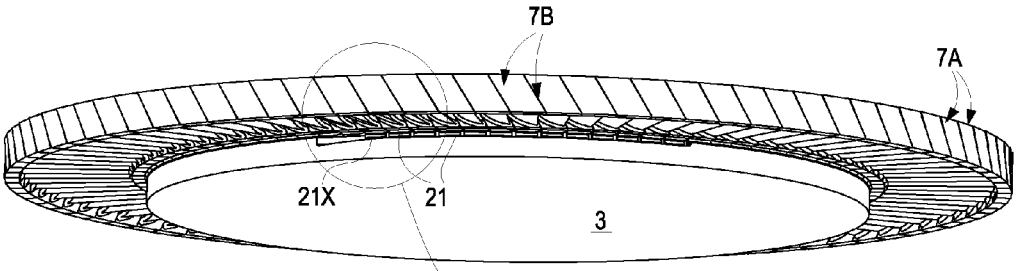
Figure 20A:
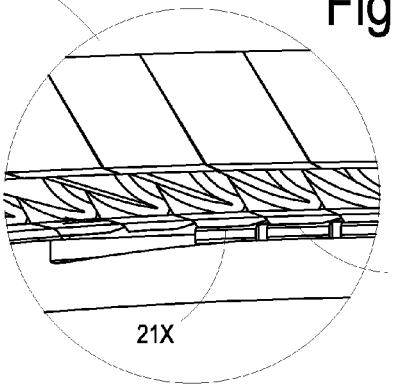
FIG. 20A illustrates an enlargement of a detail of FIG. 20.

In the over-twisted position (FIGS. 15, 16, 17) each blade 7B takes a tangential dimension, i.e. a dimension in the direction fT, which is smaller than the tangential dimension of the blades 7 in the final angular position (FIGS. 19, 20). This means that the blades 7B take a position of minimum pitch, smaller than the pitch between the blades of the first set of blades 7A mounted along the blade-retaining groove portion corresponding to angle α. Thus, as shown in FIGS. 15, 16 and 17, once a certain number of blades 7B have been introduced in the enlarged groove portion and over-twisted they leave a free gap G between the first blade 7A (labeled 7A1 in FIGS. 15, 16 17) of the first set of blades 7A and last blade of the second set of blades 7B, labeled 7B1.

In the free gap G which is thus formed a last blade 7BX can be introduced and twisted so as to engage the root portion 7R thereof in the blade-retaining groove 5. See FIG. 17. The tangential dimension of gap G is larger than the width of the T-shaped section of the root portion 7R, so that the last blade 7BX can be introduced in the gap with the surfaces 15A of the indentations 15, parallel to the rotation axis X-X of the rotor 1 and subsequently twisted around its own radial axis Y-Y to take the final position, with the surfaces 15A orthogonal to the rotation axis X-X.

Figure 18:
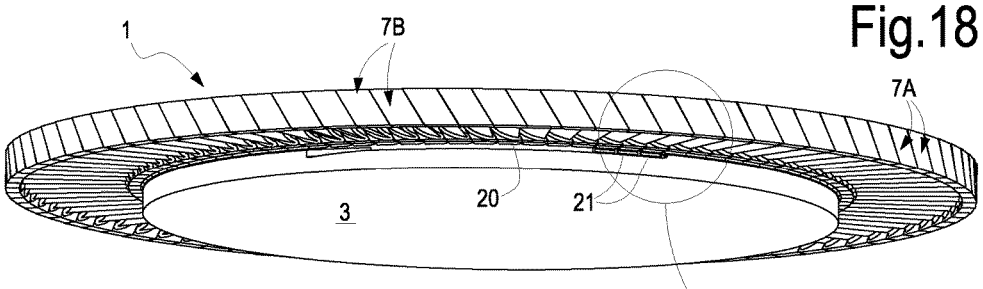
FIG. 18 illustrates a perspective view of the rotor drum with all the blades and part of the inserts mounted thereon.
Figure 18A:
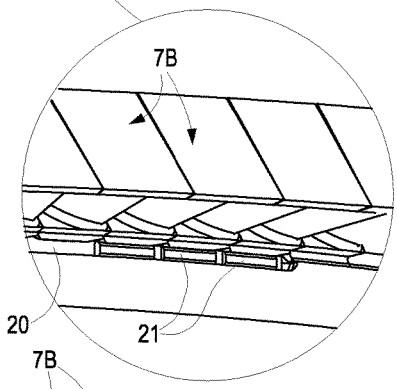
FIG. 18A illustrates an enlargement of a detail of FIG. 18.

In order to close the tangential gap G and eliminate any clearance between the blades 7A, 7B and lock the blades thus mounted in the enlarged groove portion in their final correct angular position, each blade 7B arranged along the enlarged groove portion, i.e. along the groove portion corresponding to angle β, may be twisted back from the over-twisted angular position (FIGS. 15-17) to the final angular position (FIGS. 18-20).

Figure 21:
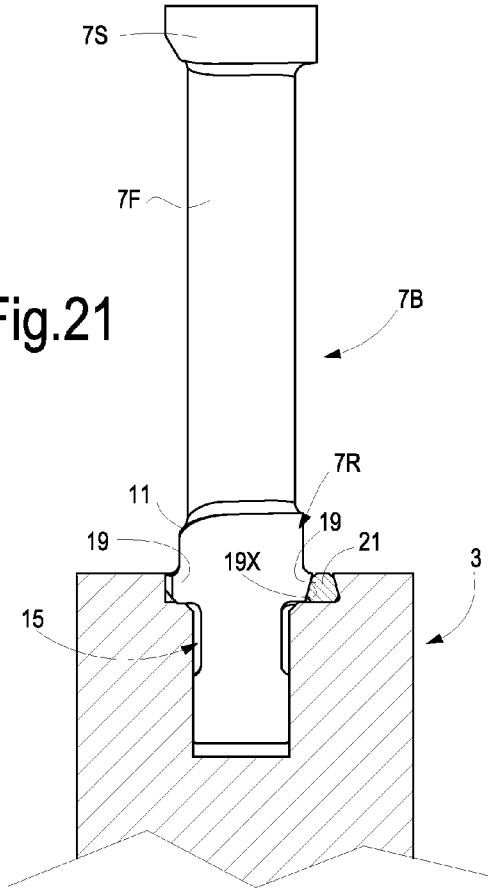
FIG. 21 illustrates a section according to a radial plane of one of the blades of the second set in the assembled and locked condition.

To move each over-twisted blade 7B, 7B1, 7BX back to the final angular position, tangential inserts 21 are introduced in a seat 20 formed along the enlarged groove portion between the side wall or side surface 5F' and the slanted surface 19X of the ledge 19 facing the side wall 5F'. FIG. 21 show a cross-section of the enlarged groove portion with a blade root portion 7R and an insert 21 inserted between the blade root 7R and the surface 5F'.

In the embodiment illustrated in the drawings, a number of inserts 21 identical to the number of blades 7B, 7B1, 7BX arranged along the enlarged groove portion are introduced in the seat 20. This, however, is not mandatory. A different number of inserts 21 can be used. In some embodiments, more inserts 21 than blades 7B along angle β can be used. Vice-versa, a number of inserts 21 smaller than the number of the blades 7B of the second set can be provided in the seat 20. In some embodiments a single insert 21 can be introduced in the tangential seat formed between blades 7B and the side surface 5F' of the blade-retaining groove 5.

Figure 22:
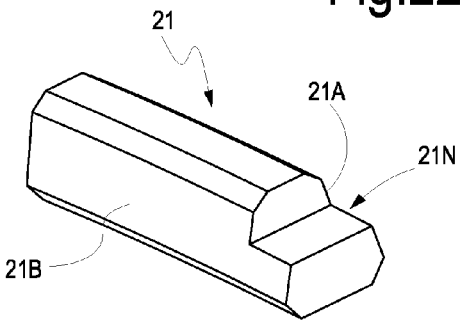
FIG. 22 illustrates a perspective view of one of the inserts used to lock the blades in their final angular position.
Figure 23:
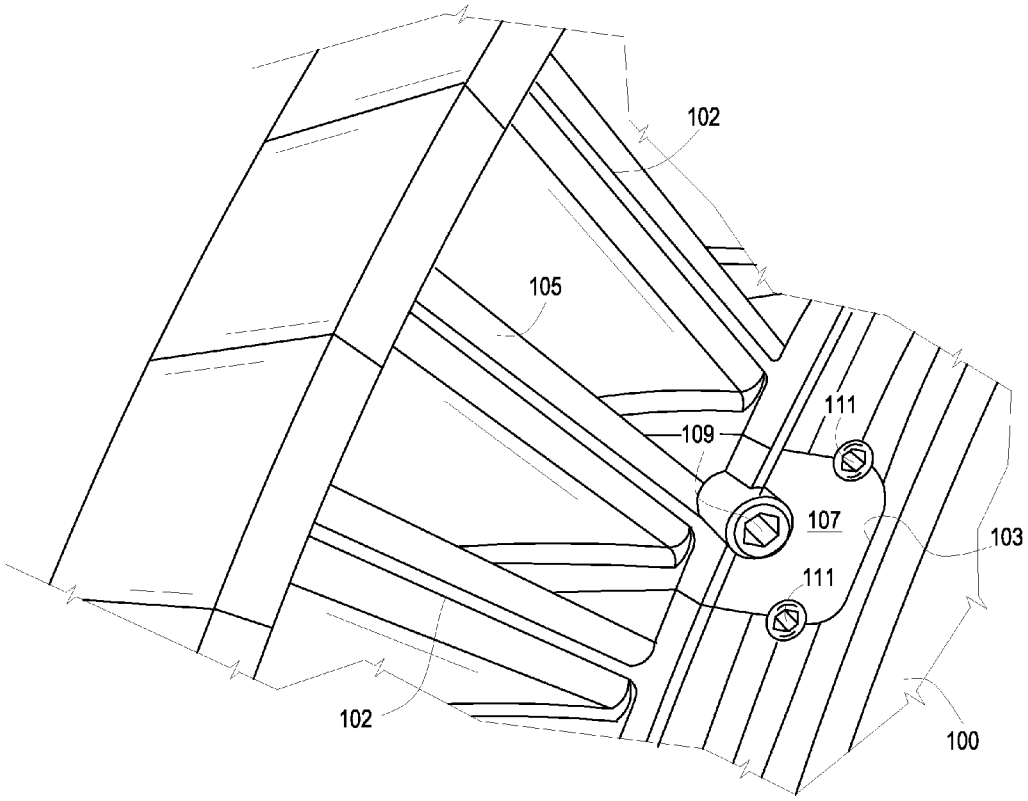
FIG. 23 illustrates a system for mounting blades on a rotor according to the current art.

The cross sectional shape and dimension of each insert 21 and of the seat 20 are such that the inserts 21 engage in the seat 20 pushing the respective blades 7B in the final angular position rotating them around their radial axes Y-Y. Each insert 21 can be provided with opposing slanted side surfaces 21A and 21B as shown in FIG. 22. The surfaces 21A and 21B converge radially outwardly, so that each insert 21 has a generally wedge-shaped cross section. The inclination of the slanted side surfaces 21A and 21B can be identical or similar to the inclination of the side wall 5F' and of the surface 19X of the ledges 19 of blades 7B located along the enlarged groove portion of the blade-retaining groove 5. By sequentially introducing inserts 21 in the seat 20 the blades 7B along the enlarged groove portion are rotated or twisted about their respective radial axis Y-Y in the final position and locked in the position by the interference between the inserts 21 and the side walls 5F', 19X of the seat 20. Such interference increases as long as more inserts are introduced and more blades 7B are forced in their final angular position. In FIG. 18 the first three inserts 21 have been introduced in the tangential seat 20. In FIGS. 19, 20 the total number of inserts 21 have been introduced in the seat 20 and all blades 7B are locked in their final angular position about the respective radial axes.

The wedge-shaped cross section of the inserts 21 and the corresponding slanted shape of the surfaces or walls 19X and 5F' generate a radial retention effect, preventing the inserts 21 from moving away from the seat 20 under the effect of the centrifugal force during operation of the turbomachine. As noted above, the wall 5F' can be shaped differently, provided it forms an undercut to radially retain the inserts 21.

Figure 8:
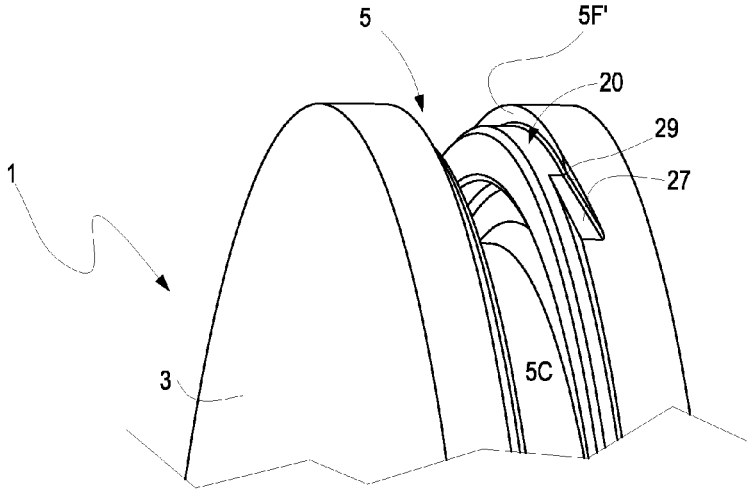
FIG. 8 illustrates a detail of a peripheral portion of the rotor drum of FIG. 7.
Figure 12:
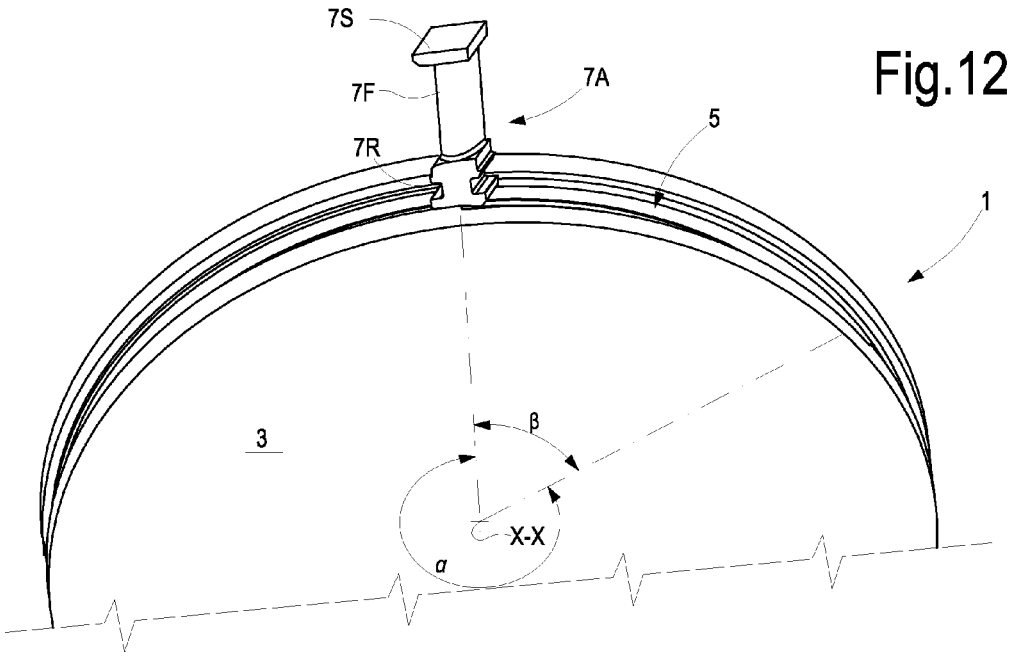
FIGS. 12 and 13 illustrate two steps of the mounting process of a blade of the first set of blades.

In some embodiments, at one end (5Y in the example) of the enlarged groove portion flared guide surfaces can be provided, to facilitate the tangential insertion of the inserts 21 between the slanted side surface or wall 5F' and the slanted surfaces 19X of the ledges 19. FIGS. 8 and 9 schematically show a possible shape of the flared guide surfaces provided at the inlet end 5Y of the enlarged groove portion, where the inserts 21 are introduced. In some embodiments a bottom guide surface 27 and a side flared surface 29 can be provided, defining a sliding and guide surface for the inserts 21.

In some embodiments the last introduced insert 21, located at the inlet end of the enlarged groove portion (position 5Y) can be constrained to the rotor 1. For example the last insert 21 (labeled 21X in FIGS. 19 and 20) can be soldered, welded, screwed, glued or constrained in any other suitable way to the rotor drum 3. Constraining of the last insert 21X to the rotor drum 3 is particularly simple, since during operation of the turbomachine the inserts 21 are subject to strong centrifugal forces acting in the radial direction and counter-acted by the wedge-shaped cross section of the inserts 21 and of the seat 20 where the latter are introduced, while substantially no forces or only negligible forces are applied in the tangential direction. The constraining means provided for constraining the last inserts 21 tangentially to the rotor 1 are therefore provided just for the sake of additional safety.

In the embodiment disclosed so far the inserts 21 are introduced in the seat 20 with a substantially tangential movement, with the aid of the flared guide and slide surfaces 27, 29. In some embodiments, not shown, insertion can be through a radial slot machined in the rotor drum 3 and reaching a depth substantially corresponding to the bottom of the seat 20. Once an insert 21 has been introduced radially in the slot, it can be shifted with a tangential movement into seat 20.

Rotation of the blades 7B arranged along the enlarged groove portion between point 5X and point 5Y, in the final angular position (FIGS. 19, 20), increases the tangential dimension of each such blade. The number of blades and the shape thereof are chosen such that in the final assembled position a complete ring of blades will be formed, where each blade is forced in the tangential direction against the neighboring blades removing any clearance between the blades. The platforms 11 of the sequentially arranged blades 7A, 7B will contact each other forming a continuous annular collar surrounding the blade-retention groove 5. The shroud portions 7S of the blades, if provided, will contact each other along respective side edges. Some degree of interference between the mutually abutting shroud portions 7S can be generated, which can torsionally bias the airfoil portion 7F, if so required.

The inserts 21 thus lock the entire ring of blades 7A, 7B in the final position. The back twisting of the blades 7A, 7B along the enlarged groove portion (angle β) from the over-twisted position to the final assembled position, caused by the introduction of the inserts 21, removes the clearance between blades.

Disassembling of the blades, for example for maintenance or repairing purposes, is obtained by a reversed sequence of operations. Firstly, the last introduced insert 21X is removed. If a constraining member, such as a screw, is provided, which locks tangentially the insert 21 to the rotor drum 3, the constraining member is removed. Afterwards the inserts 21X, 21 are sequentially removed from the seat 20 by tangentially sliding them out of the seat 20 along the blade-retaining groove 5. The blades 7BX, 7B1, 7B arranged along the enlarged groove portion between point 5X and point 5Y are over-twisted in their position of minimum tangential dimension, thus creating a free gap G, where the blade 7BX can be twisted about the radial axis Y-Y thereof by approximately 90° until the surfaces 13 of the blade root 7R are positioned approximately orthogonal to the rotation axis X-X of the rotor 1. Once this angular position has been achieved, the T-shaped part of the root portion 7R of blade 7BX can be disengaged from the undercut 5D formed in the bottom portion 5C of the blade-retaining groove 5. The blade 7BX can thus be radially removed. The remaining blades 7B, 7A can now be individually rotated about approx. 90° and radially extracted from the blade-retaining groove 5 by disengaging the respective T-shaped section of each blade from the undercut 5D.

Removal of the inserts 21 can be facilitated by providing a notch or the like on each inert 21X, 21. In FIG. 22 a notch 21N is provided at one end of the insert 21. A tool, such as a screwdriver, can engage the notch 21N to push the insert 21 out of the seat 20.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

What is claimed is:

1. A turbomachine assembly comprising:

a rotor and a ring of blades mounted on said rotor, each blade comprising an airfoil portion and a root portion inserted in a circumferential blade-retaining groove of the rotor;

wherein said blade-retaining groove comprises a second groove portion, the blades in the second groove portion being rotatable around a respective, generally radial axis, to take a position of minimum tangential dimension; and wherein at least one removable insert is arranged along said second groove portion, between the root portions of the blades located in the second groove portion and a side wall of the blade-retaining groove, to force and lock the blades in a final assembled arrangement; and wherein said blades are divided into a first set of blades and a second set of blades, said second set of blades being arranged along the second groove portion and the first set of blades being arranged along the remaining of said blade-retaining groove; and wherein one ledge of the blades of the second set of blades has a smaller axial extension than ledges of the first set of blades, and a slanted surface co-acting with said at least one insert.

2. The turbomachine assembly according to claim 1, wherein said at least one removable insert is housed in a tangentially extending seat formed between the root portions of the blades and the side wall of the second groove portion, said seat and said at least one insert having a cross section configured to radially retain the insert in the seat.

3. The turbomachine of claim 1, comprising a plurality of said inserts, arranged tangentially along the second groove portion.

4. The turbomachine assembly according to claim 1, wherein said blade-retaining groove has an inlet slot and a bottom portion forming a blade-retaining undercut; and wherein along the second groove portion said inlet slot has an axial dimension larger than in the remaining part of said blade-retaining groove.

5. The turbomachine assembly according to claim 4, wherein along said second groove portion the inlet slot forms an undercut, which radially retains said least one insert.

6. The turbomachine assembly according to claim 1, wherein each blade comprises a blade platform between the respective airfoil portion and the root portion; and wherein said at least one removable insert is forcedly engaged between a side wall of the groove and the platform of the respective blades along the second groove portion.

7. The turbomachine assembly according to claim 1, wherein the second groove portion and the root portions of the blades arranged there along form opposite undercuts, radially retaining said at least one insert therebetween.

8. The turbomachine assembly according to claim 1, wherein said at least one inset is provided with sloped, radially outwardly converging lateral surfaces, co-acting with the blade root portions and the second groove portion for radially retaining the insert in said second groove portion.

9. The turbomachine assembly according to claim 1, wherein said second groove portion has an inlet end, through which said at least one insert is introduced into or removed from the second groove portion.

10. The turbomachine assembly according to claim 1, wherein said at least one insert is tangentially constrained to the rotor, preventing tangential displacement thereof with respect to the rotor.

11. The turbomachine assembly according to claim 1, comprising a number of removable inserts corresponding to the number of blades in the second groove portion.

12. A turbomachine assembly comprising:

a rotor and a ring of blades mounted on said rotor, each blade comprising an airfoil portion and a root portion inserted in a circumferential blade-retaining groove of the rotor;

wherein said blade-retaining groove comprises a second groove portion, the blades in the second groove portion being rotatable around a respective, generally radial axis, to take a position of minimum tangential dimension; and wherein at least one removable insert is arranged along said second groove portion, between the root portions of the blades located in the second groove portion and a side wall of the blade-retaining groove, to force and lock the blades in a final assembled arrangement;

wherein said second groove portion has an inlet end, through which said at least one insert is introduced into or removed from the second groove portion; and wherein the inlet end has a flared guiding surface for introducing said at least one insert in the second groove portion and for removing the insert from the second groove portion.

13. The turbomachine assembly according to claim 12, wherein each root portion of said blades comprises opposite axially extending ledges co-acting with opposed tangentially extending side walls of the groove, to retain each blade in a fixed angular position with respect to a radially extending axis of the blade; and wherein along said second groove portion said at least one insert is arranged between one of said axially extending ledges of the blades arranged along the second groove portion and an opposing tangentially extending side wall of the groove, said insert forcedly engaging between the axially extending projection and the side wall of the groove, thus retaining the blades in the final angular position.

14. The turbomachine assembly of claim 13, wherein: the axially extending ledges of said blades contacting said at least one insert form an undercut and the side wall of the second groove portion facing said axially extending ledges form an opposite undercut; said undercuts radially retaining said at least one insert in the second groove portion.

15. The turbomachine assembly according to claim 12, wherein said inlet end has a bottom surface and a side surface forming a flared inlet aperture, extending tangentially and radially from an outer surface of the rotor in the second groove portion.

16. The turbomachine of claim 12, comprising a plurality of said inserts, arranged tangentially along the second groove portion.

17. The turbomachine assembly according to claim 12, wherein each blade comprises a blade platform between the respective airfoil portion and the root portion; and wherein said at least one removable insert is forcedly engaged between a side wall of the groove and the platform of the respective blades along the second groove portion.

18. The turbomachine assembly according to claim 12, wherein the second groove portion and the root portions of the blades arranged there along form opposite undercuts, radially retaining said at least one insert therebetween.

19. The turbomachine assembly according to claim 12, wherein said at least one inset is provided with sloped, radially outwardly converging lateral surfaces, co-acting with the blade root portions and the second groove portion for radially retaining the insert in said second groove portion.

20. The turbomachine assembly according to claim 12, wherein said at least one insert is tangentially constrained to the rotor, preventing tangential displacement thereof with respect to the rotor.

21. The turbomachine assembly according to claim 12, comprising a number of removable inserts corresponding to the number of blades in the second groove portion.

* * * * *